United States Patent [19]

Donaldson

[11] Patent Number: 4,823,703

[45] Date of Patent: Apr. 25, 1989

[54] ARMOR PENETRATING AND SELF-LUBRICATING PROJECTILE

[75] Inventor: Coleman D. Donaldson, Gloucester, Va.

[73] Assignee: The Titan Corporation, San Diego, Calif.

[21] Appl. No.: 83,814

[22] Filed: Aug. 11, 1987

[51] Int. Cl.[4] ..... F42B 13/06

[52] U.S. Cl. ..... 102/521; 102/511; 102/518

[58] Field of Search ..... 102/511, 517, 518, 519, 102/520, 521, 522, 523, 703

[56] References Cited

U.S. PATENT DOCUMENTS

| | | | |
|---|---|---|---|
| 644,361 | 2/1900 | Luciani | 102/519 |
| 4,638,738 | 1/1987 | Bisping et al. | 102/517 |
| 4,643,099 | 2/1987 | Luther et al. | 102/517 |
| 4,671,181 | 6/1987 | Romer et al. | 102/518 |
| 4,706,569 | 11/1987 | Wallow et al. | 102/518 |
| 4,768,441 | 9/1988 | Theis | 102/517 |

*Primary Examiner*—Harold J. Tudor
*Assistant Examiner*—Richard W. Wendtland
*Attorney, Agent, or Firm*—Larson and Taylor

[57] ABSTRACT

The present invention relates to an armor penetrating projectile having a substantial length-to-diameter ratio with a penetrating sabot surrounding the projectile and utilizing a conventional sabot for lauching the projectile. The penetrator of the projectile is provided with means for receiving a material higher in density and having a lower melting point than the material of the penetrated armor for providing lubrication for the penetrator upon impact.

10 Claims, 1 Drawing Sheet

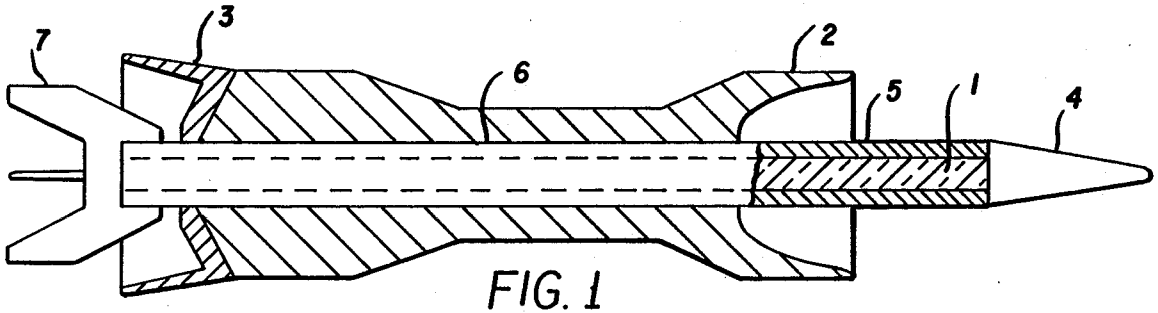
FIG. 1
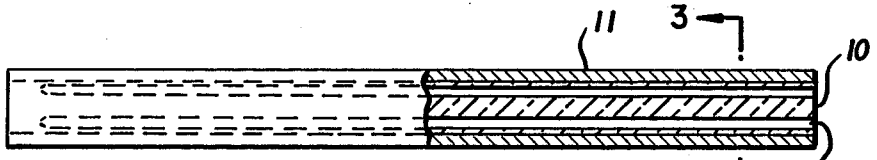
FIG. 2
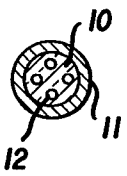
FIG. 3
FIG. 4
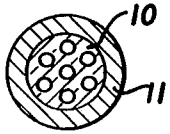
FIG. 5
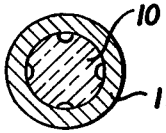
FIG. 6
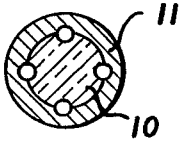
FIG. 7

ARMOR PENETRATING AND SELF-LUBRICATING PROJECTILE

The present invention relates to an armor-piercing projectile capable of penetrating targets having multiple layer armor. The penetrator of the present invention has a length-to-diameter ratio which is substantially greater than that of conventional penetrators and is provided with a penetrating sabot which provides stability and strength to the penetrator. The penetrator is provided with self-lubricating and/or drag reducing means to facilitate passage of the penetrator through multi-layered armor, including ceramic.

BACKGROUND OF THE INVENTION

It is well known in the prior art that in order to increase the penetration of a projectile of a certain weight it is necessary to increase the length-to-diameter ratio of the projectile. The Montier et al. U.S. Pat. No. 4,616,569 describes an armor-penetrating projectile having a substantial length-to-diameter ratio and density. In the projectile described in this patent, there is provided an inner member of greater strength and elasticity than the outer member. The inner member is inserted in a bore extending through the projectile.

It is also known in the prior art to provide a lubricant for a projectile to reduce friction when penetrating armor. The Kelson U.S. Pat. No. 4,239,006 discloses a sabot for firearms which is made from a thermoplastic resin containing finely divided lubricant fillers which engage the periphery of the cartridge. The resin provides a lubricant for the cartridge as it passes through the armor. The Gilbert U.S. Pat. No. 4,112,846 discloses an armor-piercing incendiary projectile wherein the incendiary material provides both cushioning and lubrication for the penetrator. U.S. Pat. No. 4,428,295 discloses a high density shot which is composed of two metal powders, one being more dense than lead and the other being flowable upon compaction to serve as a binder for the shot.

While the prior art devices suggest the need for increasing the length-to-diameter ratio of projectiles to increase their armor penetrating ability and, while the prior art also discloses structure for self-lubricating penetrators, there are no projectiles presently available which can achieve the degree of penetration possible with the presently disclosed projectile which has a length-to-diameter ratio greater than 20 without any sacrifice of additional weight and still maintaining sufficient strength and stability to pierce multi-layered armor. In addition, the penetrator is provided with self-lubricating and/or drag reducing means which facilitates the passage of the penetrator through the multi-layered target containing ceramic.

SUMMARY OF THE INVENTION

The present invention provides a projectile having a penetrator with a length-to-diameter ratio greater than 20. In order to utilize such an elongated penetrator without increasing the weight of the penetrator such as would decrease the velocity of the projectile, it is necessary to provide a penetrating sabot which surrounds the penetrator, the sabot being made of a less dense material than the penetrator but which provides strength and stability for the elongated penetrator. A conventional sabot which serves to carry the penetrator during launching inside the gun barrel engages the external surface of the penetrating sabot and transmits the launching thrust of the charge acting on the rear surface of the sabot to the penetrator.

The penetrator according to the present invention has one or more holes therein to receive a material which is more dense than that of the penetrator and which has a low melting point so that, as the penetrator itself is decelerated upon entering the target, the lubricant is injected inertially ahead of the penetrator. The low melting point lubricant forms a slurry with the hard granular shards of broken ceramic armor thus facilitating the passage of the penetrator through the armor.

An object of the present invention is to provide an improved armor-piercing projectile having a length-to-diameter ratio substantially greater than known projectiles to enhance the armor-piercing capability of the projectile.

Another object of the present invention is to provide a penetrator for a projectile having a length-to-diameter ratio greater than 20 with a cylindrical sleeve of low density forming a penetrating sabot and surrounding the penetrator to increase the strength and stability of the penetrator.

Still another object of the present invention is to provide a projectile with a penetrator having self-lubricating means therein which is released upon impact of the projectile with the target.

Still another object of the present invention is to provide a penetrator with at least one recess to receive a material of higher density than the penetrator and a low melting point so that the high density material is released inertially upon impact to serve as a lubricant for the penetrator.

Other objects and many of the attendant advantages of the present invention will become apparent upon consideration of the following detailed specification when considered in connection with the accompanying drawings wherein:

BRIEF DESCRIPTION OF THE DRAWINGS

FIG. 1 is a cross-sectional elevation of an armor-penetrating projectile according to the present invention, FIG. 2 is a sectional view of the penetrator having lubricating means therein, FIG. 3 is a sectional view of FIG. 2 along the line 3—3, and FIGS. 4–7 inclusive are cross-sectional views similar to FIG. 3 showing alternative arrangements of the lubricating means.

DETAILED DESCRIPTION

Referring now more specifically to the drawings wherein like numerals indicate like parts throughout the several views there is shown at 1 in FIG. 1 a penetrator which comprises a long cylindrical rod of high density metal such as, for example, tungsten alloy. A sabot is shown at 2, the sabot comprising a device for retaining the penetrator in proper alignment with the gun barrel during launching. The sabot 2 may be made of a light-weight metal or plastic and is provided with an obturator 3 which is designed to seal the gun barrel against the release of high pressure gases so that the entire thrust of the high pressure gases will be passed through the obturator and sabot to the projectile being launched. The sabot 2 has the outer diameter thereof in contact with the bore of the gun barrel, and the inner diameter of the sabot is engaged with the penetrator so that the penetrator cannot move with respect to the sabot until after the projectile has been launched. The sabot is made in segments such that, once the sabot is outside the gun barrel, the aerodynamic forces on the front surface of the sabot result in radial separation of the sabot segments from the penetrator.

The penetrator 1 has a length-to-diameter ratio of at least 20 and has a nose cone 4 comprising a streamlined conical fairing of lightweight material which is attached to the front end of the penetrator 1 to reduce the aerodynamic drag of the penetrator. It will be noted that the diameter of the base of the conical nose cone is greater than the diameter of the penetrator 1 and a cylindrical tube 5 fits around the penetrator 1 and the forward end of the tube 5 abuts the base of the nose cone. The cylindrical tube 5 serves as a penetrating sabot and enhances the structural strength and stiffness of the penetrator. This strength and stiffness enhancement is required due to the loss of strength and stiffness resulting from the elongation and relatively small diameter of the penetrator 1. The penetrating sabot is securely attached to the penetrator so as to provide strength and stiffness for the penetrator during launch, flight and upon impact. This attachment may be by mechanical means such as threads or by shrink fitting, adhesive bonding, brazing, soldering and the like. Alternatively, the penetrating sabot may be formed directly on the penetrator by metallic deposition, superplastic forming, diffusion bonding or fiber reinforced layup with resin. The penetrating sabot 5 is made of a material lower in density than that of the penetrator and may be made, for example, of steel, titanium or aluminum or alternatively may be made of filament wound composite plastic. The penetrating sabot is designed such that the weight of the penetrating sabot together with that of the weight of the lengthened penetrator 1 is equal to the weight of a conventional prior art penetrator. The outer diameter of the combined penetrator 1 and the penetrating sabot 5 is typically approximately one and one-half times the diameter of the penetrator itself. Normally, in operation, penetrators of this type usually make impact holes of approximately twice the diameter of the penetrator. Thus, the penetrating sabot can enter the penetration hole unimpaired and continue to provide support for the penetrator during impact. These diameter ratios become larger the higher the impact velocity.

The outer surface of the penetrating sabot 5 is provided with annular zero pitch threads or similar mechanical means which are designed to transmit the axial thrust from the sabot 2 to the penetrator 1 during launch and also to allow radial aerodynamic separation of the sabot 2 during flight. The aft end of the penetrator is provided with stabilizing fins 7 which are fixedly attached to the penetrator for the purpose of providing aerodynamic stability during flight.

In FIG. 2 there is shown a penetrator 10 having a cylindrical tube forming a penetrating sabot 11 permanently fastened thereto by any well known means referred to hereinbefore. The penetrator 10 is provided with a plurality of holes 12 and, as shown in FIG. 3, there are provided four holes 12 which are disposed symmetrically within the body of the penetrator. These holes are filled with a lubricant which is released upon impact with a target to enhance the penetration capability of the projectile. The lubricant must be of a density higher than that of the penetrator so that, as the penetrator itself is decelerated upon entering the target, the lubricant is injected inertially ahead of the penetrator where it is needed. An example of a suitable lubricant material for a penetrator made of tungsten alloy having a density of 17 g/cm$^3$ would be a mixture of 80% pure tungsten powder and 20% lead. The mixture of tungsten powder and lead would have a density of 18 g/cm$^3$. Thus, the lead and tungsten mixture would be injected ahead of the penetrator and the lead, which has a low melting point, would melt and form a slurry with the high density particles of pure tungsten and the shards of broken ceramic armor so as to facilitate passage of the penetrator through the armor.

FIGS. 4–7 inclusive show cross sections of the penetrator 10 and penetrating sabot 11 similar to FIG. 3 with different arrangements of holes. FIG. 4 discloses a single hole in the center of the penetrator, FIG. 5 discloses an axial center hole surrounded by a number of parallel holes. FIG. 6 discloses axial grooves in the surface of the penetrator 10 and FIG. 7 discloses four holes which span the interface of the penetrator 10 and the penetrating sabot 11.

As noted hereinbefore, the penetrator of the presently disclosed projectile has a length-to-diameter ratio of greater than 20. This increases its penetration capability in comparison with a penetrator of equal weight and lesser length-to-diameter ratio. In principle, the only way to double the penetration of a penetrator rod into, say, a semi-infinite piece of rolled homogeneous steel armor is to double its length. However, the weight cannot be doubled, for the energy that the typical launching gun can deliver is limited, and too much velocity would be lost. It is, therefore, necessary to decrease the penetrator diameter. If the new and longer rod with length $L_2$ is to weigh the same as the shorter prior art rod, which has a length of $L_1$, then the diameters of these two rods must be in the ratio $D_2/D_1=(L_1/L_2)^{\frac{1}{2}}$. Thus, the L/D ratio has increased as $L_2$ is made larger than $L_1$ in the ratio $$\frac{(L/D)_2}{(L/D)_1}=\left(\frac{L_2}{L_1}\right)^{3/2}$$

Thus, doubling penetration requires increasing the L/D by a factor of 2.8.

Obviously there are problems in simply increasing the length of the penetrator without increasing the weight of the penetrator. The problem arises in the saboting and manufacture of a finer and finer rod. The finer the rod, the less stability and strength the rod possesses, and an essential feature of the present invention is providing sufficient stability for a long rod penetrator by utilizing an encasing cylindrical sabot which remains with the penetrator in its flight to the target. Since a high speed heavy penetrator makes a hole that is roughly twice the diameter of the penetrator, the diameter of the sabot that will encase the penetrator and will remain with the penetrator to impact is somewhat smaller, say, one and one-half times the diameter of the penetrator. The length of the penetrating sabot is made approximately equal to that of the penetrator. Thus, the penetrator becomes a long rod penetrator that is stabilized during launch and during penetration by that part of the sabot that remains an integral part of the penetrator.

More specifically, the following detailed explanation will more clearly define the technology of the present invention. Assume a heavy rod of density $\rho_1$, length $L_1$, and diameter $D_1$. Suppose it is desired to apply the penetrating sabot to a penetrator having a length $L_2$ that is one and one-half times $L_1$. The penetrator, or core, of the assembled round is to have a density $\rho_{2c}-\rho_1$, and the penetrating sabot is of density $\rho_{2s}$. The diameter of this penetrating saboted round is $D_2$. It is also supposed that the core $D_2$ is such that $D_2/D_{2c}=2$, so that the sabot will go into the armor through the hole made by the penetrator. If the weights of the two rounds are to be the same, the following equation applies:

$$L_2\ [(0.5D_2)^2\rho_{2c} + (D_2^2 - 0.25D_2^2)\rho_{2s}] = L_1D_1^2\rho 1,$$

Since $\rho_2 = \rho_1$, $$\frac{L_2}{L_1}\left(\frac{D_2}{D_1}\right)^2\left[0.25 + 0.75\frac{\rho_{2s}}{\rho_1}\right] = 1$$

or $$\frac{D_1}{D_2} = \left[\frac{L_2}{L_1}\left(0.25 + 0.75\frac{\rho_{2s}}{\rho_1}\right)\right]^{\frac{1}{2}}$$

Then, $$\frac{(L/D)_2}{(L/D)_1} = \left[\left(\frac{L_2}{L_1}\right)^3\left(0.25 + 0.75\frac{\rho_{2s}}{\rho_1}\right)\right]^{\frac{1}{2}}$$

To increase the penetration by making $L_2/L_1=1.5$, the following equation applies:

$$\frac{(L/D)_2}{(L/D)_1} = \left[(1.5)^3\left(0.25 + 0.75\frac{\rho_{2s}}{\rho_1}\right)\right]^{\frac{1}{2}}$$

Assuming the core specific gravity to be that of tungsten (19.6), and computing $(L/D)_2/(L/D)_1$ for several different penetrating sabot materials when $L_2/L_1=1.5$, the following values are obtained.

| Penetrating Sabot Material | Specific Gravity | $D_2/D_1$ | $(L/D)_2/(L/D)_1$ |
|---|---|---|---|
| Tungsten | 19.6 | 0.82 | 1.84 |
| Steel | 7.85 | 1.10 | 1.36 |
| Titanium | 4.54 | 1.25 | 1.20 |
| Aluminum | 2.7 | 1.43 | 1.09 |
| Wound hi-tech composite | 1.5 | 1.47 | 1.02 |

For a typical case, assume a heavy penetrator (specific gravity 19.6) that has an L/D of 20. Assume a diameter of 40 mm and length of 800 mm. The normal penetration into rolled homogeneous steel armor at 1.5 km/sec is approximately 400 mm. It is desired to increase the penetration by 1.5 times so that it will penetrate into approximately 600 mm of rolled homogeneous steel armor at 1.5 km/sec. Compared below are the characteristics of the original round and the elongated or stretched rounds with various penetrating sabot materials used:

| Round | L(mm) | D(mm) | L/D | W(kg) | Approx. P(mm) |
|---|---|---|---|---|---|
| Original round | 500 | 25.0 | 20.0 | 4.8 | 400 |
| Stretched round | 750 | 20.4 | 36.7 | 4.8 | 600 |
| Steel penetrating sabot round | 750 | 27.5 | 27.3 | 4.8 | 600 |
| Titanium penetrating sabot round | 750 | 31.3 | 24.0 | 4.8 | 600 |
| Aluminum penetrating sabot round | 750 | 35.7 | 21.0 | 4.8 | 600 |
| Composite penetrating sabot round | 750 | 36.8 | 20.4 | 4.8 | 600 |

The stretched round referred to above would provide a theoretical penetration of 600 mm, but the penetrator would not have sufficient structural stability or strength to permit it to be launched by conventional techniques. However, by using a penetrating sabot surrounding the elongated penetrator to provide sufficient strength and stability for launch and flight, the desired penetration should be possible.

With respect to the lubrication aspect of the present invention illustrated in FIGS. 2–7 inclusive, this is particularly useful in connection with penetrating ceramic armors. Ceramic armors require large energy to penetrate, in that substantial energy is dissipated as the penetrator forces its way through shattered ceramic shards at high velocity. It is the high melting temperature of ceramic which accounts for the dissipation of energy being so high. By providing a penetrator with a lower melting point material that can, in small amounts, penetrate ahead of the main penetrator, it is possible to reduce the resistant capabilities of the ceramic armor. This is achieved by reason of the lower melting point material forming a slurry with the ceramic shards and thus reducing the energy required for the penetrator to pass through the ceramic armor. The holes in the penetrator illustrated in FIGS. 2–7 inclusive also performs the function of reducing the drag of the penetrator as it passes through the ceramic armor due to the shape change associated with the way the rod containing holes erodes.

Obviously many modifications and variations of the present invention are possible in light of the above teachings.

What is claimed as new and is desired to be secured by Letters Patent is:

1. A projectile adapted to be launched from a gun barrel including a penetrator comprising a long cylindrical rod of high density metal, a penetrating sabot comprising a cylindrical tube of lower density than said penetrator surrounding said penetrator, a sabot engageable with said penetrating sabot to transmit axial thrust from the sabot to said penetrating sabot and said penetrator when the projectile is being launched from the gun barrel, said sabot being separable from said penetrating sabot and said penetrator during flight of the projectile, and at least one cavity within said penetrator and a lubricant filling said cavity, said lubricant having a higher density than the metal of said penetrator and a lower melting point than the material of the penetrated armor.

2. A projectile according to claim 1 wherein said penetrator has a length-to-diameter ratio greater than 20.

3. A projectile according to claim 1 wherein said penetrating sabot has a diameter approximately twice the diameter of said penetrator.

4. A projectile according to claim 1 wherein said penetrator has a nose cone on the forward end thereof and the penetrating sabot surrounds the penetrator from the forward end to the rear end and has an outer diameter substantially equal to the outer diameter of the base of the nose cone.

5. A projectile adapted to be launched from a gun barrel comprising a penetrator including a cylindrical rod having a length-to-diameter ratio greater than 20, means to strengthen and structurally stabilize said penetrator during flight including a sleeve surrounding said cylindrical rod, said sleeve having a density less than the density of said cylindrical rod, a separable sabot engageable with said stabilizer means while the projectile is being launched from the gun barrel and receptor means in said penetrator for receiving a lubricant having a higher density than the metal of said cylindrical rod and a lower melting point than the material of the penetrated armor.

6. A projectile according to claim 5 wherein said sleeve surrounds said cylindrical rod from end to end and said sleeve has a diameter approximately one and one-half to two times the diameter of said rod.

7. A projectile for piercing ceramic armor comprising a penetrator including a cylindrical rod, receptor means in said cylindrical rod, slurry forming means in said receptor means, said slurry forming means having a higher density than said rod and a lower melting point than the material of the penetrated armor and adapted to be injected in said armor ahead of said cylindrical rod to form a slurry with particles of ceramic armor.

8. A projectile according to claim 7 wherein said receptor means comprises a plurality of longitudinally extending holes in said cylindrical rod.

9. A projectile according to claim 8 and further including drag reducing means in said penetrator for changing the shape of the penetrator.

10. A projectile according to claim 9 wherein said drag reducing means includes at least one cavity within said penetrator.

* * * * *